US010200807B2

(12) United States Patent
Eronen et al.

(10) Patent No.: US 10,200,807 B2
(45) Date of Patent: Feb. 5, 2019

(54) AUDIO RENDERING IN REAL TIME

(71) Applicant: Nokia Technologies Oy, Espoo (FI)

(72) Inventors: Antti Eronen, Tampere (FI); Miikka Vilermo, Siuro (FI); Arto Lehtiniemi, Lempäälä (FI); Jussi Leppänen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/805,400

(22) Filed: Nov. 7, 2017

(65) Prior Publication Data

US 2018/0132053 A1 May 10, 2018

(30) Foreign Application Priority Data

Nov. 10, 2016 (EP) ..... 16198153

(51) Int. Cl.
*H04S 7/00* (2006.01)
*H04R 1/40* (2006.01)
(Continued)

(52) U.S. Cl.
CPC ..... *H04S 7/304* (2013.01); *H04R 1/406* (2013.01); *H04R 5/02* (2013.01); *H04R 5/027* (2013.01); *H04R 5/04* (2013.01); *H04S 3/008* (2013.01); *H04R 2420/01* (2013.01); *H04S 1/005* (2013.01); *H04S 2400/11* (2013.01); *H04S 2400/15* (2013.01); *H04S 2420/01* (2013.01)

(58) Field of Classification Search
CPC .. H04S 2420/01; H04S 7/304; H04S 2400/11; H04S 2420/11; H04S 7/306; H04R 3/005; H04R 2201/401; H04R 25/552; H04R 1/406; H04R 5/027; H04R 1/20; H04R 2203/12; H04R 1/1016; H04R 1/265
See application file for complete search history.

(56) References Cited

U.S. PATENT DOCUMENTS 5,796,843 A 8/1998 Inanaga et al.
9,319,821 B2 * 4/2016 Arrasvuori ..... H04S 7/302
(Continued)

FOREIGN PATENT DOCUMENTS

EP 1551205 A1 7/2005
GB 2543275 A 4/2017
GB 2543276 A 4/2017

OTHER PUBLICATIONS

Extended European Search Report received for corresponding European Patent Application No. 16198153.5, dated Jul. 17, 2017, 7 pages.

*Primary Examiner* — Mohammad Islam
(74) *Attorney, Agent, or Firm* — Harrington & Smith

(57) ABSTRACT

A method comprising: receiving audio input from multiple microphones; receiving position information for the multiple microphones; selecting in dependence upon positions of the microphones, at least a first microphone as a source of audio input forming a first output;

selecting in dependence upon positions of the microphones, at least a second microphone as a source of audio input forming a second output; and enabling live rendering of audio by providing the first output for rendering via a left loudspeaker and the second output for rendering via a right loudspeaker.

19 Claims, 3 Drawing Sheets

(51) Int. Cl.

| | |
|---|---|
| ***H04R 5/02*** | (2006.01) |
| ***H04R 5/04*** | (2006.01) |
| ***H04S 3/00*** | (2006.01) |
| ***H04R 5/027*** | (2006.01) |
| *H04S 1/00* | (2006.01) |

(56) References Cited

U.S. PATENT DOCUMENTS

| | | | | |
|---|---|---|---|---|
| 2007/0009120 | A1* | 1/2007 | Algazi | H04R 5/027 381/310 |
| 2014/0198918 | A1* | 7/2014 | Li | H04S 7/30 381/26 |
| 2015/0049892 | A1* | 2/2015 | Petersen | H04R 25/554 381/315 |
| 2015/0249898 | A1* | 9/2015 | Horbach | H04S 1/005 381/309 |
| 2016/0165350 | A1* | 6/2016 | Benattar | H04R 5/033 381/310 |
| 2017/0064444 | A1* | 3/2017 | Tawada | H04S 7/307 |
| 2017/0353812 | A1* | 12/2017 | Schaefer | H04S 7/303 |
| 2017/0359671 | A1* | 12/2017 | Eronen | H04S 7/303 |

* cited by examiner

AUDIO RENDERING IN REAL TIME

TECHNOLOGICAL FIELD

Embodiments of the present invention relate to audio rendering of real time. In particular, they relate to audio rendering in real time of sound recorded for spatial audio processing.

BACKGROUND

Spatial audio processing involves the localization of a sound object (a sound source) in a three dimensional space.

For a person wearing headphones a sound object may be located at a three dimension position (e.g. at (r, ϑ, Φ) in spherical co-ordinates) by providing an appropriate input signal $x_L(t)$ to a left ear loudspeaker and an appropriate input signal $x_R(t)$ to a right ear loudspeaker.

The input signal $x_L(t)$ is produced by processing the audio signal x(t) using a first head related transfer HRTF (r', ϑ', Φ', L) for the left ear.

The input signal $x_R(t)$ is produced by processing the audio signal x(t) using a second head related transfer HRTF (r', ϑ', Φ', R) for the right ear.

The location of the sound object in a frame of reference of the sound space (r, ϑ, Φ) is mapped into a location of the sound object in a listener's frame of reference (r', ϑ', Φ'). The orientation of the listener's frame of reference is determined by the orientation of the listener's head. This allows a sound source to be correctly placed in the sound space while the listener moves his head.

BRIEF SUMMARY

According to various, but not necessarily all, embodiments of the invention there is provided a method comprising: receiving audio input from multiple microphones; receiving position information for the multiple microphones; selecting in dependence upon positions of the microphones, at least a first microphone as a source of audio input forming a first output; selecting in dependence upon positions of the microphones, at least a second microphone as a source of audio input forming a second output; and enabling live rendering of audio by providing the first output for rendering via a left loudspeaker and the second output for rendering via a right loudspeaker.

Live rendering of audio is thus enabled without performing spatial audio processing and the time lag that would be introduced by spatial audio processing is avoided.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
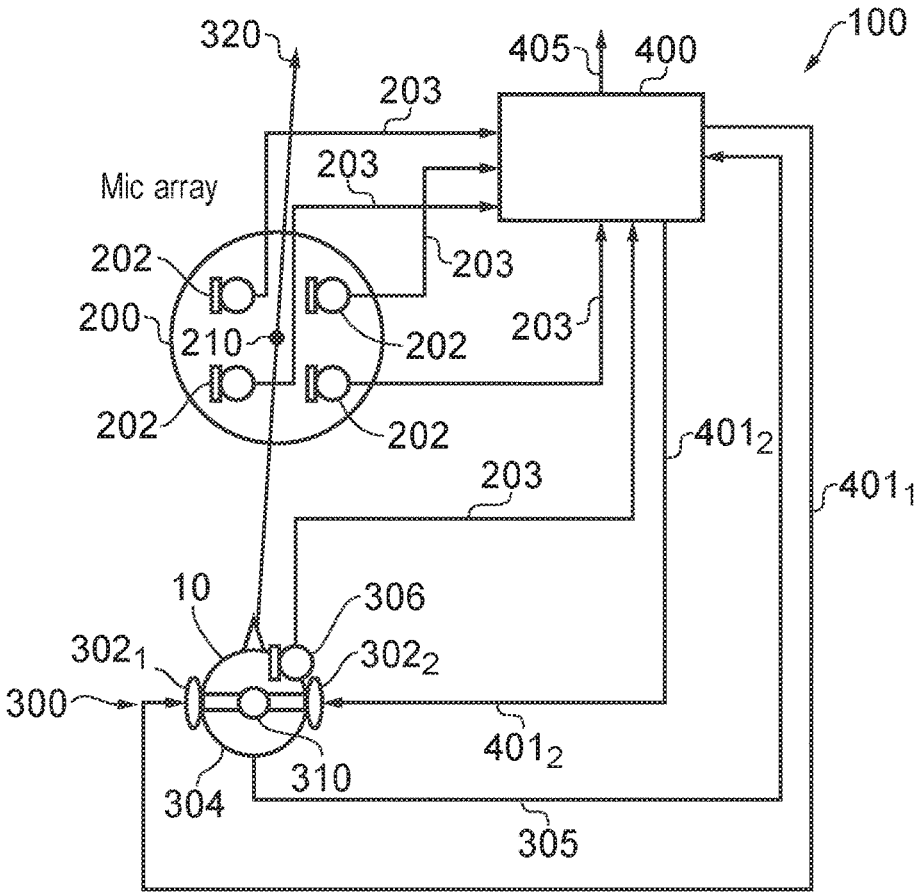
FIG. 1 illustrates an example of a system for recording audio, processing audio and rendering audio.

FIG. 1 illustrates an example of a system 100 for recording audio, processing audio and rendering audio.

The system 100 comprises an audio processing system 400, an arrangement 200 of microphones 202 and a headset 300 worn by a listener 10.

The arrangement 200 of microphones 202 comprises a plurality N (N≥3) of spatially distributed microphones 202. In the example illustrated, there are four microphones distributed in two dimensions. However, in other examples there may be three or more microphones and in some examples the microphones may be distributed in three dimensions.

The arrangement 200 of microphones 202 may be a device comprising the microphones 202 in a fixed spatial configuration. Alternatively one or more of the microphones 202 may be a portable microphone.

Each of the microphones 202 records audio and provides an audio input signal 203 to the audio processing system 400.

The headset 300 comprises a left ear loudspeaker $\mathbf{302}_1$ and a right ear loudspeaker $\mathbf{302}_2$. The left loudspeaker $\mathbf{302}_1$ is placed over a left ear of a listener 10 and the right loudspeaker $\mathbf{302}_2$ is placed over a right ear of a listener 10. The audio processing system 400 enables live rendering of audio via the headphones 300 by providing a first output $\mathbf{401}_1$ for rendering audio via the left loudspeaker $\mathbf{302}_1$ of the headphones 300 and a second output $\mathbf{401}_2$ for rendering audio via the right loudspeaker $\mathbf{302}_2$ of the headphones 300.

In this example, but not necessarily all examples, the headset 300 comprises a microphone 306 for providing an audio input signal 203 to the audio processing system 400. The listener 10 is able to simultaneously record audio via the microphone 306 while listening to live rendered audio from the audio processing system 400 which may include the audio input by the listener 10.

Figure 2:
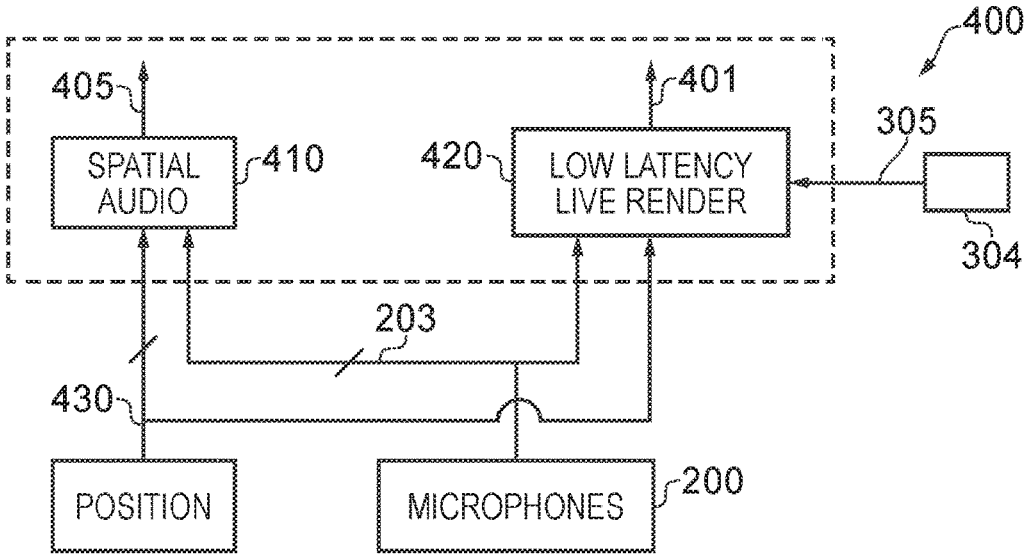
FIG. 2 illustrates an example of an audio processing system.

FIG. 2 illustrates an example of an audio processing system 400 in more detail.

In this example, the audio processing system 400 comprises a spatial audio processing block 410 and a low latency live rendering block 420. The blocks may be provided by different circuitry and/or different functional software.

The spatial audio processing block 410 receives the audio input signals 203 from the microphones, such as, for example, the arrangement 200 of microphones 202. The spatial audio processing block 410 also receives positioning information 430 that positions each of the microphones 202.

The spatial audio processing block 410 is configured to process input audio signals 203 to produce an output 405 that enables the rendering of one or more sound objects in three dimensional positions. If each microphone 202 records a recorded sound object then the output 405 of the spatial audio processing block 410 defines multiple rendered sound objects at controlled positions within a three dimensional sound space. The position information 430 may track the positions of an origin of an audio input signal 203 such as a person or a moving up-close microphone 202 that records the sound object and the output 205 enables the spatial rendering of the recorded sound object at that position or a different position as a rendered sound object.

Binaural coding may be used to produce an output 405 suitable for rendering via headphones using a head related transfer function (HRTF) for the headphones. The output 405 may additionally or alternatively be configured for loudspeaker rendering. The spatial audio processing block 410 may, for example, perform loudspeaker panning to correct for spatial location using Vector Base Amplitude Panning (VBAP).

It will be appreciated by a person skilled in this art that the spatial audio processing block 410 needs to perform a large number of operations and that there is a time lag or a potential time lag between the audio input signals 203 being received and the production of the output 405 based on those signals. This means that it is not desirable to use the output 405 from the spatial audio processing block 410 for live rendering of audio to the listener 10 via the headphones 300.

The audio processing system 400 additionally comprises a low-latency live-rendering block 420 for rendering live audio, based upon the input audio signals 203 from the microphones 202, to the listener 10 via the headphones 300 with low-latency.

The block 420, like the spatial audio processing block 410, receives the input audio signals 203 from the microphones, such as the arrangement 200 of microphones 202. It also receives positioning information 430 that positions the microphones 202. In some examples, this information may also provide information concerning the orientation of the microphones.

In this example, the block 420 also receives a positioning input 305 that positions the listener 10 relative to the arrangement 200 of microphones 202. In this example, the headphones 300 comprise a positioning tag 304 that enables the positioning information 305 to be provided to the block 420, positioning the listener 10.

In some examples the positioning information 305 may also provide information concerning the orientation of the listener 10.

It should be noted that the output 401 to the headphones is from the low-latency live-rendering block 420 and is not from the spatial audio processing block 410.

Figure 3:
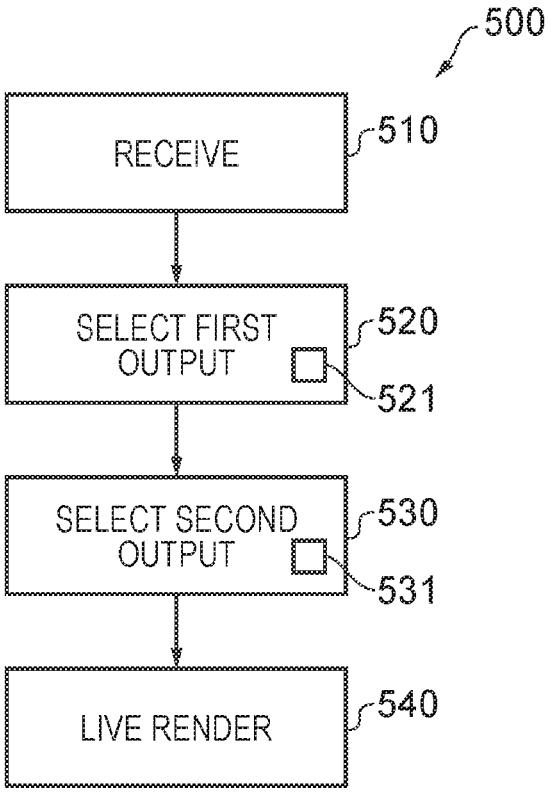
FIG. 3 illustrates an example of a method.

FIG. 3 illustrates an example of a method 500 that may be performed by the low-latency live-rendering block 420 illustrated in FIG. 2.

At block 510, the method 500 comprises receiving audio input 203 from multiple microphones 202.

At block 520, the method 500 comprises selecting at least a first microphone as a source of audio input forming a first output $\mathbf{401}_1$.

At block 530, the method 500 comprises selecting at least a second microphone 202 as a source of audio input forming a second output $\mathbf{401}_2$.

At block 540, the method 500 comprises enabling live rendering of audio via headphones 300 by providing the first output $\mathbf{401}_1$ for rendering via a left ear loudspeaker $\mathbf{302}_1$ of the headphones 300 and the second output $\mathbf{401}_2$ for rendering via a right ear loudspeaker $\mathbf{302}_2$ of the headphones 300.

The audio signal from the first microphone is provided with no or little processing to the headphones 300 as the first output $\mathbf{401}_1$. The audio signal from the first microphone is not spatially audio processed to produce the first output $\mathbf{401}_1$.

The audio signal from the second microphone is provided with no or little processing to the headphones 300 as the second output $\mathbf{401}_2$. The audio signal from the second microphone is not spatially audio processed to produce the second output $\mathbf{401}_2$.

As previously described in relation to FIG. 2, the method 500 may also comprise receiving position information 430 for the multiple microphones 202 and receiving position information 305 for the listener 10.

At block 520, the selection of the first microphone as a source may be a selection performed in dependence upon a first criteria 521, e.g. the position of the microphones 202. At block 530 the selection of the second microphone as a source may be a selection made in dependence upon a second criteria 531, e.g. the position of the microphones 202.

The audio processing system 400 may be implemented as a controller 400.

Implementation of a controller 400 may be as controller circuitry. The controller 400 may be implemented in hardware alone, have certain aspects in software including firmware alone or can be a combination of hardware and software (including firmware).

Figure 4A:
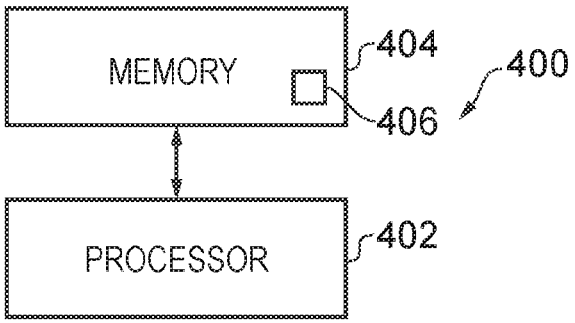
FIG. 4A illustrates an example of a controller.

As illustrated in FIG. 4A the controller 400 may be implemented using instructions that enable hardware functionality, for example, by using executable instructions of a computer program 406 in a general-purpose or special-purpose processor 402 that may be stored on a computer readable storage medium (disk, memory etc) to be executed by such a processor 402.

The processor 401 is configured to read from and write to the memory 404. The processor 402 may also comprise an output interface via which data and/or commands are output by the processor 402 and an input interface via which data and/or commands are input to the processor 402.

The memory 404 stores a computer program 406 comprising computer program instructions (computer program code) that controls the operation of the apparatus 400 when loaded into the processor 402. The computer program instructions, of the computer program 406, provide the logic and routines that enables the apparatus to perform the methods illustrated in FIGS. 1-4. The processor 402 by reading the memory 404 is able to load and execute the computer program 406.

The apparatus 400 therefore comprises:

at least one processor 402; and at least one memory 404 including computer program code the at least one memory 404 and the computer program code configured to, with the at least one processor 402, cause the apparatus 400 at least to perform:

- receiving audio input from multiple microphones;
- causing selecting of at least a first microphone as a source of audio input to be used without spatial audio processing as a first output;
- causing selecting at least a second microphone as a source of audio input to be used without spatial audio processing as a second output; and
- enabling live rendering of audio by providing the first output for rendering via a left loudspeaker and the second output for rendering via a right loudspeaker.

Figure 4B:
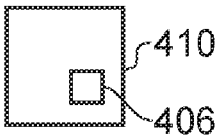
FIG. 4B illustrates an example of a record medium comprising a computer program.

As illustrated in FIG. 4B, the computer program 406 may arrive at the apparatus 400 via any suitable delivery mechanism 410. The delivery mechanism 410 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 406. The delivery mechanism may be a signal configured to reliably transfer the computer program 406. The apparatus 400 may propagate or transmit the computer program 406 as a computer data signal.

Although the memory 404 is illustrated as a single component/circuitry it may be implemented as one or more separate components/circuitry some or all of which may be integrated/removable and/or may provide permanent/semi-permanent/dynamic/cached storage.

Although the processor 402 is illustrated as a single component/circuitry it may be implemented as one or more separate components/circuitry some or all of which may be integrated/removable. The processor 402 may be a single core or multi-core processor.

Figure 5A:
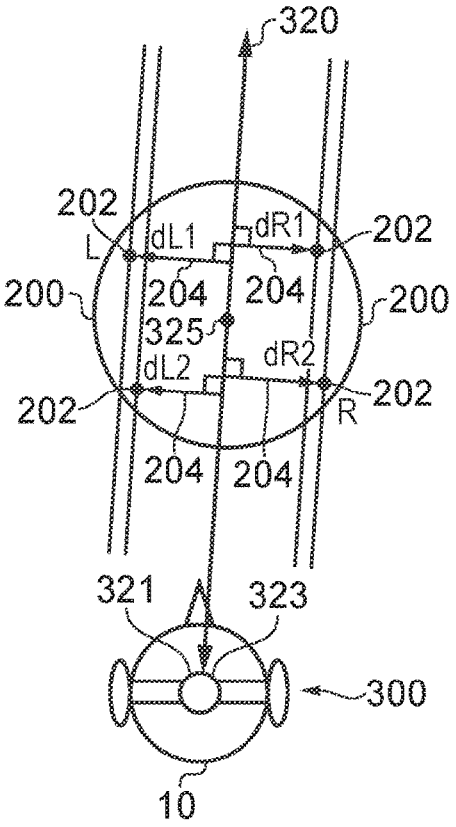
FIG. 5A to 5C illustrate criteria for selecting a first microphone as a source from amongst the multiple microphones and for selecting a second microphone as a source from amongst the multiple microphones.
Figure 5B:
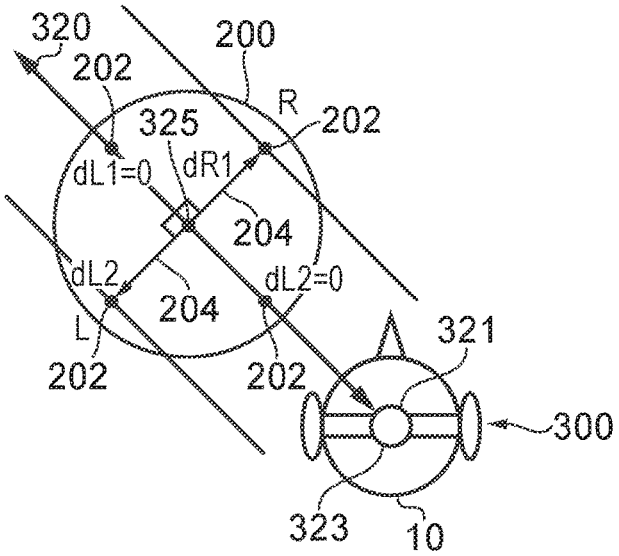
Figure 5C:
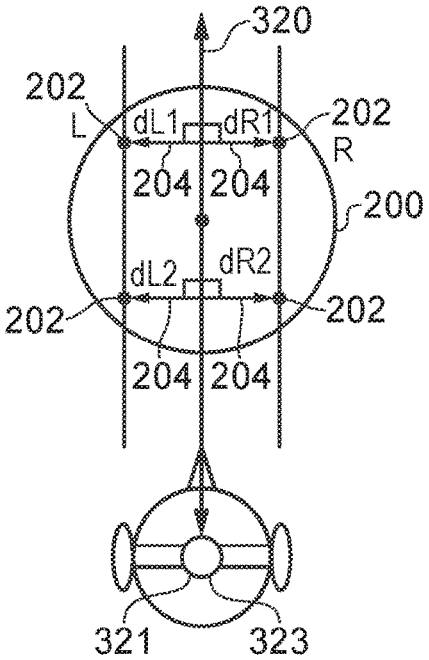

FIGS. 5A to 5C illustrate in more detail aspects of examples of the invention and in particular different criteria for selecting a first microphone as a source from amongst the multiple microphones 202 and for selecting a second microphone as a source from amongst the multiple microphones 202.

In these examples the selection of the first microphone (L) and the second microphone (R) is a selection made in dependence upon a relative position of those microphones with respect to the listener 10. The first microphone (L) is selected as a source in dependence upon satisfaction of a first position criteria and the second microphone (R) is selected as a source in dependence upon satisfaction of a second position criteria.

The position criteria may relate to a stereo criteria and/or a distance criteria, for example.

An example of at least one first position criteria (stereo criteria) is that the first microphone (L) is on the first (left) side of a vertical plane 320 defined by a position 321 of the listener 10 and the microphones 202. Likewise at least one second position criteria is that the second microphone (R) is on a second, different side (right side) of the vertical plane 320.

In the examples of FIGS. 5A to 5C, a vertical plane 320 passes through an origin 323 at the listener 10 and a virtual centre 325 of the arrangement 200 of microphones 202.

If each of N microphones has a vector position $r_i$ then the virtual center is at $(\Sigma_N\ r)/N$ Alternatively if each of N microphone has vector position $r_i$ then virtual center is at $(\Sigma_N\ r_i w_i)/N$ where $w_i$ is a weighting that may be dependent upon a characteristic of the audio signal $w_i$ captured by the microphone at position $r_i$.

An example of at least one first position criteria (distance criteria) is a first distance criteria to be satisfied by a position of the first microphone and an example of at least one second position criteria (distance criteria) is a second distance criteria to be satisfied by the position of the second microphone.

In some examples a distance criteria may assess the position of the first microphone (vector position $r_i$). In other examples a distance criteria may assess an adapted position of the first microphone (vector position $w_i\ r_i$, where $w_i$ is a weighting that may be dependent upon a characteristic of the audio signal $w_i$ captured by the microphone at position $r_i$). In some but not necessarily all examples, $w_i$ may also depend on orientation of the microphone and its directional gain.

In the example of FIG. 5A, only one first microphone (L) is selected as a source of audio input forming the first output $\mathbf{401}_1$. Also, only one second microphone (R) is selected as a source of audio input forming the second output $\mathbf{401}_2$.

A number of different examples of distance criteria will now be described with reference to FIGS. 5A to 5C.

In some examples, the first distance criteria is maximizing a distance between the first microphone (L) and the vertical plane 320 and the second distance criteria is maximizing a distance between the second microphone (R) and the vertical plane 320. This is, for example, illustrated in FIGS. 5A and 5B.

However, other different distance criteria may be used.

Another example of the first distance criteria and the second distance criteria is minimizing a distance between the first and second microphones (L, R) while maintaining a minimum spatial separation between the first and second microphones. The minimum spatial separation, may, for example, be defined with respect to a human inter-ear distance. The minimum spatial separation may additionally or alternatively be defined along a vector 204 normal to the vertical plane 320 defined with respect to the listener 10.

Another example of the first distance criteria and the second distance criteria is minimizing a distance between the first microphone (L) and the listener 10 and minimizing a distance between the second microphone (R) and the listener 10 while maintaining a minimum spatial separation between the microphones. The minimum spatial separation may be defined with respect to a human inter-ear distance and/or may be defined along a vector 204 normal to the vertical plane 320.

Another example is where the first distance criteria and the second distance criteria minimize a difference between a distance between the microphones and the human inter-ear distance. The distance between the microphones may be defined along separate vectors.

In the foregoing examples, a distance between two microphones 20 or between a microphone and the plane 320 may be defined along one or more vectors 204 normal to the vertical plane 320 defined with respect to the listener 10 and through the microphones 202.

FIG. 5C illustrates an example in which a first set of microphones 202 is selected as a mixed source of audio input forming the first output $\mathbf{401}_1$. In this particular example, the figure also illustrates selecting at least a second set of microphones as a mixed source of audio input forming the second output $\mathbf{401}_2$, however, it is not necessary for mixed sources to be used for both the first output $\mathbf{401}_1$ and the second output $\mathbf{401}_2$. A mixed source may be provided for only one of the first output $\mathbf{401}_1$ and the second output $\mathbf{401}_2$.

A criteria for deciding whether or not to use a single microphone as the source of audio input forming the first output $\mathbf{401}_1$ or to use multiple microphones as sources of audio input that are to be mixed to form the first output $\mathbf{401}_1$ may be based upon the positions of the microphones of the first set. For example, when there is a very small difference in distance between microphones they may be grouped as a first set.

In the example of FIG. 5C the microphones to the right of the plane 320 are at approximately the same distance from the plane 320 and the difference in distance between those microphones and the first plane is less than a threshold. These microphones are therefore grouped into a set of microphones to be used as a mixed source of audio input forming a second output $\mathbf{401}_2$. The mixing may be a weighted mixing, for example, proportional to or dependent upon the distances of a microphone from the plane 320. The distance between the microphones 202 may be defined along separate vectors 204 normal to the vertical plane.

Referring to FIGS. 5A and 5B and also the FIG. 5C it can be observed that as a listener 10 position changes relative to the arrangement 200 of microphones 202, the microphones 202 that are used as the first microphone (L) and as the second microphone (R) change. This change may, for example occur because the listener 10 moves and/or because the arrangement 200 of microphones 202 moves and/or because the arrangement 200 of microphones 202 changes. The arrangement 200 of microphones 202 may change because at least one microphone moves and/or because at least one microphone is added (physically or functionally) and/or because at least one microphone is removed (physically or functionally).

The criteria for changing the first microphone (L) may be different from the original criteria for selecting the first microphone (L). The different criteria may for example introduce hysteresis.

The criteria for changing the second microphone (R) may be different from the original criteria for selecting the second microphone (R). The different criteria may for example introduce hysteresis.

For example, the first microphone may be changed in dependence upon satisfaction of a further first distance criteria different to the first distance criteria and changing the second microphone may occur in dependence upon satisfaction of a further second distance criteria different to the second distance criteria. The criteria to initially select a microphone as the first/second microphone needs to be exceeded to switch the first/second microphone. The criteria may be exceeded by a threshold distance, or exceeded for a threshold time or exceeded for both a threshold distance and a threshold time.

The above method enables live rendering of audio by providing the first output for rendering via a left loudspeaker and the second output for rendering via a right loudspeaker. In some embodiments, only the first output is provided to the left loudspeaker and only the second output is provided to the right loudspeaker. However, in other examples, a mix of the first output and the second output is provided to the left loudspeaker and a mix of the second output and the first output is provided to the right loudspeaker.

Let us define an orientation direction D of the listener. This may be defined, for example, by the direction in which a listener's nose points, or in the reference frame of the headset 300 worn by the listener 10 it may be defined as the vector that passes through an origin midway between the left loudspeaker and the right loudspeaker and is normal (orthogonal) to a vertical plane passing through the origin, and the left and right loudspeakers. Let us define an offset angle $\alpha$ between the plane 320 and the orientation direction D of the listener. $\alpha$ is positive when the orientation direction D is to the right of the plane 320 and negative when the orientation direction D is to the left of the plane 320.

Let the input signal to the left ear loudspeaker be $x_L(t)$ and the input signal to a right ear loudspeaker be $x_R(t)$. Let the first output be $y_L(t)$ and the second output be $y_R(t)$.

The input signal to the left ear loudspeaker $x_L(t)$ may be a mix of the first output $y_L(t)$ and the second output $y_R(t)$ and the input signal to the right ear loudspeaker $x_R(t)$ may be a mix of the second output $y_R(t)$ and the first output be $y_L(t)$. e.g.

$$x_L(t)=y_L(t)*[\cos(\alpha)]^2+y_r(t)*[\sin(\alpha)]^2$$

$$x_R(t)=y_R(t)*[\cos(\alpha)]^2+y_L(t)*[\sin(\alpha)]^2$$

In addition a head shielding effect may be introduced by additionally setting:

$$x_L(t)=a(\alpha)*y_L(t)$$

$$x_R(t)=b(\alpha)*y_R(t)$$

The multiplier $a(\alpha)$ may for example be a value that monotonically varies between 1 and 0. The multiplier $b(\alpha)$ may for example be a value that monotonically varies between 1 and 0. The multipliers $a(\alpha)$ and $b(\alpha)$ may be the same functions but offset by a defined angle $\alpha_0$ which may, for example, be 90°.

The multipliers $a(\alpha)$ and $b(\alpha)$ may both be 1 when the listener directly faces the arrangement 200 ($\alpha$=0).

The multipliers $a(\alpha)$ and $b(\alpha)$ may both be 0 when the listener directly faces away from the arrangement 200 ($\alpha$=180, −180).

| $\alpha$ | $a(\alpha)$ | $b(\alpha)$ |
|---|---|---|
| −180° to −90° | 0 | linearly increasing from 0 to 1 |
| −90° to 0° | linearly increasing from 0 to 1 | 1 |
| 0° to 90° | 1 | linearly decreasing from 1 to 0 |
| 90° to 180° | linearly decreasing from 1 to 0 | 0 |

In some but not necessarily all examples, the audio processing system 400 may adapt the output signals 401 so that the route mean energy of the signals is adjusted dynamically in dependence upon the spatial audio processing performed by spatial audio processing block 410. They may, for example, be adjusted to match the output energy levels of the spatial audio 405.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present. This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in the FIGS. 1-4 may represent steps in a method and/or sections of code in the computer program 406. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one" or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method comprising: receiving audio input from multiple microphones; receiving location information for the multiple microphones; receiving location information for a listener; selecting at least a first microphone of the microphones as a source of audio input forming a first output, wherein selecting the first microphone is based on satisfaction of at least one first position criterion, wherein the at least one first position criterion comprises a location of the first microphone being on a first side of a vertical plane, wherein the vertical plane is defined based on a location of the listener and the locations of the microphones, wherein the vertical plane passes through the location of the listener and a virtual center of the multiple microphones; selecting at least a second microphone of the microphones as a source of audio input forming a second output, wherein selecting the second microphone is based on satisfaction of at least one second position criterion, wherein the at least one second position criterion comprises a location of the second microphone being on a different, second side of the vertical plane; and enabling live rendering of audio to the listener by providing the first output for rendering via a first speaker and the second output for rendering via a second speaker.

2. A method as claimed in claim 1, comprising selecting only the first microphone as an only source of audio input forming the first output and selecting only the second microphone as an only source of audio input forming the second output.

3. A method as claimed in claim 1 wherein selecting the at least one first microphone and the at least one second microphone is further based on relative positions of the microphones.

4. A method as claimed in claim 1, wherein the at least one first position criterion comprises at least one first distance criterion to be satisfied by a position of the first microphone and the at least one second position criteria is criterion comprises at least one second distance criteria to be satisfied by a position of the second microphone.

5. A method as claimed in claim 4, wherein at least one of: the at least one first distance criterion comprises maximizing a distance between the first microphone and the vertical plane and the at least one second distance criterion is maximizing a distance between the second microphone and the vertical plane; the at least one first distance criterion and the at least one second distance criterion comprise maximizing a distance between the first and second microphones while maintaining a minimum spatial separation between the first and second microphones; the at least one first distance criterion and the at least one second distance criterion comprise minimizing a distance between the microphones and the listener while maintaining a minimum spatial separation between the microphones; or the at least one first distance criterion and the at least one second distance criterion comprise minimizing a difference between a distance between the microphones and a human inter-ear distance.

6. A method as claimed in claim 5, wherein the minimum spatial separation is defined with respect to a human inter-ear distance and/or is defined along one or more vectors normal to the vertical plane defined with respect to the listener.

7. A method as claimed in claim 5, wherein the distance between the microphones is defined along separate vectors normal to the vertical plane.

8. A method as claimed in claim 4 further comprising changing the first microphone in dependence upon satisfaction of a further first distance criterion different to the first distance criterion and/or changing the second microphone in dependence upon satisfaction of a further second distance criterion different to the second distance criterion.

9. A method as claimed in claim I further comprising selecting at least a first set of the microphones as a mixed source of audio input forming the first output and/or selecting at least a second set of the microphones as a mixed source of audio input forming the second output.

10. A method as claimed in claim 9, wherein selecting the first set and/or the second set of multiple microphones as a mixed source of audio input occurs when a difference in the distance between the microphones of a set is less than a threshold.

11. A method as claimed in claim 1 further comprising recording and rendering audio produced by the listener in real time.

12. An apparatus comprising: at least one processor; and at least one memory including computer program code, the at least one memory and the computer program code configured to, with the at least one processor, cause the apparatus at least to perform: receiving audio input from multiple microphones; receiving location information for the multiple microphones; receiving location information for a listener; selecting at least a first microphone of the microphones as a source of audio input forming a first output, wherein selecting the first microphone is based on satisfaction of at least one first position criterion, wherein the at least one first position criterion comprises a location of the first microphone being on a first side of a vertical plane, wherein the vertical plane is defined based on a location of the listener and the locations of the microphones, wherein the vertical plane passes through the location of the listener and a virtual center of the multiple microphones; selecting at least a second microphone of the microphones as a source of audio input forming a second output, wherein selecting the second microphone is based on satisfaction of at least one second position criterion, wherein the at least one second position criterion comprises a location of the second microphone being on a different, second side of the vertical plane; and enabling live rendering of audio to the listener by providing the first output for rendering via a first speaker and the second output for rendering via a second speaker.

13. The apparatus of claim 12, wherein the computer program code is further configured to cause the apparatus to select only the first microphone as an only source of audio input forming the first output and selecting only the second microphone as an only source of audio input forming the second output.

14. The apparatus of claim 12, wherein the computer program code is further configured to cause the apparatus to select the first microphone and the second microphone in dependence upon relative positions of the microphones.

15. The apparatus of claim 12, wherein the computer program code is further configured to cause the apparatus to select at least a first set of the microphones as a mixed source of audio input forming the first output and/or selecting at least a second set of the microphones as a mixed source of audio input forming the second output.

16. A non-transitory computer readable medium comprising computer program code stored thereon, the computer readable medium and computer program code being configured to, when run on at least one processor, perform at least the following: receiving audio input from multiple microphones; receiving location information for the multiple microphones; receiving location information for a listener;

Selecting at least a first microphone of the microphones as a source of audio input forming a first output, wherein selecting the first microphone is based on satisfaction of at least one first position criterion, wherein the at least one first position criterion comprises a location of the first microphone being on a first side of a vertical plane, wherein the vertical plane is defined based on a location of the listener and the locations of the microphones, wherein the vertical plane passes through the location of the listener and a virtual center of the multiple microphones; selecting at least a second microphone of the microphones as a source of audio input forming a second output, wherein selecting the second microphone is based on satisfaction of at least one second position criterion, wherein the at least one second position criterion comprises a location of the second microphone being on a different, second side of the vertical plane; and enabling live rendering of audio to the listener by providing the first output for rendering via a first speaker and the second output for rendering via a second speaker.

17. A method of claim 1, wherein the first speaker is a left ear speaker and the second speaker is a right ear speaker.

18. A method of claim 1, wherein selecting the first microphone and the second microphone is further based on an orientation of the listener relative to positions of the microphones.

19. The apparatus of claim 12, wherein the first speaker is a left ear speaker and the second speaker is a right ear speaker.

* * * * *